United States Patent [19]

LeVan

[11] Patent Number: 4,999,232

[45] Date of Patent: Mar. 12, 1991

[54] MAKING NEW STRETCHABLE BATTS

[75] Inventor: Martin D. LeVan, Wilmington, Del.

[73] Assignee: E. I. du Pont de Nemours and Company, Wilmington, Del.

[21] Appl. No.: 494,707

[22] Filed: Mar. 16, 1990

[51] Int. Cl.[5] ..... B32B 5/12

[52] U.S. Cl. ..... 428/113; 28/112; 28/122; 156/62.8; 156/148; 156/296; 428/105; 428/284; 428/288; 428/297; 428/298; 428/300; 428/373

[58] Field of Search ..... 156/62.8, 148, 296; 428/105, 113, 284, 288, 297, 298, 300, 373; 28/112, 122

[56] References Cited

U.S. PATENT DOCUMENTS 4,426,420 1/1984 Likhyani ..... 428/224

*Primary Examiner*—James J. Bell

[57] ABSTRACT

Improved stretchable battings of differentially-shrinkable bicomponent staple fibers are obtained by cross-lapping webs, e.g. from cards, garnets or the like machines, at an angle that determines and controls the degrees of stretch in the machine direction (MD) and cross direction (XD), and then inducing helical crimp in the bicomponent fibers on account of their differential shrinkage. Such batts are especially useful in apparel.

9 Claims, No Drawings

MAKING NEW STRETCHABLE BATTS

FIELD OF INVENTION

This invention concerns the making of new stretchable batts, and more particularly to a new process for making such new batts whereby the amount of stretch can be varied and controlled in the machine and cross directions, to the resulting batts, to the processing of such batts into articles of various kinds, and to the resulting articles themselves.

BACKGROUND

Fibrous batts (sometimes referred to as battings) have been made from synthetic staple fibers, particularly from polyester fiberfill, and have been disclosed, for example, in Moler, U.S. Pat. No. 3,007,227, Willis, U.S. Pat. No. 3,290,704, Tolliver, U.S. Pat. No. 3,772,137, Scott U.S. Pat. No. 4,129,675, Street, U.S. Pat. Nos 4,668,562 and 4,753,693, and Burnett WO 88/00258 and other art referred to herein. A preferred synthetic polymer for many purposes has been polyester homopolymer, i.e. poly(ethylene terephthalate), sometimes referred to as 2G-T, and various batts of such polymer fiber have been made and used for many years as filling materials. As indicated in some of the references, for many purposes it has been found desirable to make such batts from blends of filling fiber with lower melting binder fibers that soften at temperatures appropriate for making a bonded batt, preferably sheath/core binder fibers that have a higher melting core, such as 2G-T, surrounded by a sheath of binder material, so that, upon activation of the binder material, which has usually been achieved by heating to a temperature below the melting or softening point of the core and of the filling fiber, but above the binding temperature of the binder material, the latter bonds the filling fiber and provides tie points, connected by the remaining cores of the original binder fibers.

For some uses, especially in some apparel, it has been desired to provide batts with "stretchable" characteristics, by which is meant the ability to recover from extensions such as are encountered in normal usage, and to be able to control the amount of stretch in different directions (as mentioned more hereafter). Some batts have been produced with limited extensions that have been approximately equal directionally, i.e. are not controlled as to direction of stretch; I believe such batts have been made by air-laying, e.g. on a RANDO/DOA system, or some such system of randomly laying the fibers to form the batt. Other batts with limited stretch capability have been produced from carded webs with essentially unidirectional stretch in the machine direction (MD), i.e. with no significant stretch in the cross direction (XD). Such prior batts have not fulfilled the need that has existed for such uses in apparel, such as gloves, and stretch pants, for example.

SUMMARY OF THE INVENTION

According to my invention, I provide batts with superior stretch characteristics, and more particularly the ability to control the stretch in certain directions, as determined in the method of manufacture when forming the batt, by cross-lapping webs of filling fibers that are deferentially shrinkable bicomponent fibers and have been oriented (as by carding, i.e. to impart a degree of parallelization to such fibers), and by using the differential shrinkage of the bicomponent fibers to impart stretch-recovery to such filling fibers.

So, there is provided, according to one aspect of the invention, a process for preparing stretchable fibrous battings, comprising the steps of (1) forming a carded web of bicomponent fibers, the components of which exhibit differential shrinkage, (2) cross-lapping at an angle of about 30° to about 60° to build up a batt of the desired thickness and weight, (3) stabilizing the batt with the fibers in the batt thus cross-lapped, and (4) heat-setting the batt so as to effect differential shrinkage of the bicomponent fibers and thereby impart recoverable stretch to the batt.

According to another aspect, there is provided a multilayered, cross-lapped, stretchable batt having recoverable extensions in the plane of the layers that are balanced to the extent such that the maximum recoverable extension is no more than about 1.5 times the recoverable extension in the direction at right angles to the direction of maximum recoverable extension, and comprising bicomponent fibers that have a helical curl on account of bicomponent differential shrinkage.

A preferred process for preparing stretchable fibrous battings, comprising the steps of (1) forming a blend of bicomponent fibers, the components of which exhibit differential shrinkage, with binder fibers that soften under conditions that do not soften the bicomponent fibers, (2) cross-lapping at an angle of about 30° to about 60° to build up a batt of the desired thickness and weight, (3) activating the binder fibers so as to provide a bonded batt, and (4) heat-setting the bonded batt so as to effect differential shrinkage of the bicomponent fibers and thereby impart recoverable stretch to the batt.

DETAILED DESCRIPTION OF THE INVENTION

Bicomponent filaments of differential shrinkage of various types have already been disclosed, e.g., by Reese in U.S. Pat. No. 3,998,042, and Mirhej, U.S. Pat. No. 4,157,419, and the art referred to therein, and some such bicomponent combinations have been used as filling fibers in the prior batts with limited stretch capability referred to above. According to the present invention, the different components are preferably in a side-by side relationship, so as to maximize the effect of differential shrinkage in providing a desired helical configuration or curl with stretch properties, and compatible components should be selected with the same end in view. Preferred components for some purposes are polyesters, particularly combinations that have been used and disclosed for their differential shrinkage, but other components, such as nylon may be used, e.g. a nylon 66 bicomponent with 2G-T/SSI. The copolyester often referred to as 2G-T/SSI being poly(ethylene terephthalate/5-sodium-sulfo-isophthalate) containing about 2 mole % of the ethylene 5-sodium-sulfo-isophthalate repeat units, and disclosed, e.g., by Griffing & Remington in U.S. Pat. No. 3,018,272. Other bicomponents, such as polyolefins, for instance polypropylene/-polyethylene-type bicomponents with melting point differences of the order of 50° C., may be used depending on the end-use. The ways to get differential shrinkage have been disclosed in the art, and include using entirely different polymers, or similar polymers with differences, such as differing melting points and/or differing relative viscosities to provide different shrinkages under the conditions desired (which have usually been heat-setting, e.g. in a hot oven).

As indicated, for many purposes, bonded batts are preferred. Bonding may be effected by using a resin binder, as described in the art, but, especially if through-bonding is desired, this is achieved preferably by use of binder fibers that are blended with the polyester fiber-fill. Typical binder fibers are described in the art referred to, and, for example, in copending Ahn et al, USSN 07/260,540, filed Oct. 24, 1988, and Ahn USSN 07/281,825 filed Dec. 9, 1988 and the binder fibers and references cited therein. Preferably, the difference in melting point is of the order of 100° C., especially for olefin binders. Binder fibers may be blended with the bicomponent fiberfill by methods known per se in the art, and, if desired, other components may be blended in, e.g. as disclosed, e.g., by Pamm in U.S. Pat. No. 4,281,042 and Frankosky in U.S. Pat. No. 4,304,817.

An essential element of my invention is in using cross-lapping, whereby I provide the possibility of varying and controlling the stretch characteristics of the resulting batts very simply, by altering the angle of cross-lapping the webs, and then stabilizing the angle at which the fibers are oriented relative to the batt by the cross-lapping. This contrasts with the random orientation of some prior batts referred to above; I have found the amount of (recoverable) stretch has been greater in my batts, quite apart from my ability to control and vary (in a directional sense) the amounts of stretch, which can be a very important advantage, in practice, to the user of the batts, e.g. for designing apparel and other articles, such as furniture. The angle of cross-lapping is measured herein in the cross-direction (XD), in contrast to MD for the machine-direction, and may vary, e.g. from 10° to 80°. However, in practice, angles of 30° to 60° will generally be preferred. An angle of 45° will give approximately equal stretch in both directions (MD and XD), but these stretch characteristics are found to be superior to those of the prior random batts referred to above. An angle of more than 45° will increase the MD stretch and lower the XD stretch, whereas angles of less than 45° will increase the XD stretch and correspondingly lower the MD stretch. Webs from homopolymer fibers have generally had predominantly XD stretch (rather than MD) and increasing the cross-lapping angle for such webs has had the opposite effect to what occurs according to the present invention (using bicomponent fibers to provide stretch) in relation to the MD:XD stretch ratio.

The batts are formed prior to applying heat sufficient to induce the desired differential shrinkage, and such differential shrinkage is induced later, by appropriate means, conventionally simply heating the batt, e.g. in an appropriate oven, or using hot air, by way of example. The differential shrinkage may be induced in the batt in its original lofted state. Desirably, however, in practice, the differential shrinkage is induced after stabilization of the batt, e.g. with a low level of heat (enough to provide only some slight degree of curl in the fibers sufficient to provide cohesion and stability, and possibly to activate any binder material, for instance in the form of binder fibers) and/or pressure to densify the batt or by needle-punching. Needle-punching is preferred for many end-uses, as it forms an integral batt and can minimize further change during subsequent heating.

Stabilizing is important for control, i.e., to preserve the angle of orientation of the fibers after cross-lapping, and so the eventual directional stretch characteristics. It should be understood that cross-lapping has generally been carried out merely to build up a desired weight of fiber in the batt, and precise control of any angle has not been of much concern, especially as the orientation of the fibers will likely change during later handling and processing unless and until fixed by bonding or other means.

Suitable bicomponent fibers may have a cut length of about 38 to 100 mm, and denier of 2 to 15, which is suitable for webs having a weight of 10 to 100 g/sq. meter, when processed by carding or garnetting. The webs are cross-layed (cross-lapped) onto a moving apron (floor apron). The web speed on the cross-lapper and the relative speed of the moving floor apron are controlled in a way that will allow control of the angle of the webs as they are cross-layed onto the moving apron (floor apron). The weight of the web and number of the cross-layed webs are controlled in a way that will allow control of the batting weights. All these controls are generally by variable drives which will give necessary weight and speed flexibility.

Carding or garnetting the fiber is the preferred process in order to align fibers in the machine direction (MD) of the web as produced. After cross-laying these carded, aligned fibers to a predetermined angle, subjecting the cross-lapped batting to needle punching at about 80–100 penetrations per sq. inch using a low aggression needle is the preferred method for stabilizing the batting; however, this does not preclude the option of using lofted or compressed batting.

Tests have been carried out using 2.5 denier side-by side homopolymer//copolymer bicomponent polyester fibers of 50//50 (by weight) 2G-T//2G-T/SSI. The batts have also contained about 10% by weight of MELTY 4080 as binder fiber, and TR-934 resin. The apron speed was 10 meters/minute (but may be varied conventionally, e.g. between 5 and 20 meters/minute) and the cross-lapping speed is generally 4 times as fast, and was 40 meters/minute in this test. The heating means in the first stage may conveniently be a hot roll or hot air oven, and a hot air oven has been preferred for the second stage.

Tests conducted to demonstrate the development and control of stretch using such side-by-side polyester bicomponent fibers showed the transverse web (XD) stretch was 17–21% and the machine direction (MD) was only 8% when a low cross-lap angle of 15° from XD was used. Changing the angle to 30° for the cross-lap, however, resulted in an increase in stretch to 25% MD while maintaining 17% transverse (XD). This was an unexpected result and showed the stretch responded to the angle of the fibers in the web (obtained by cross-lapping and stabilizing).

Battings produced as described above may, as indicated, if desired, contain a suitable percentage (e.g. 10 to 20% by weight) of low melt binder fibers. These may be a sheath core or a side-by-side type wherein the sheath or one side melts at a suitable temperature, preferably between 100° and 130° C. Whether the batting contains binder fiber or not, the batting is preferably initially subjected to about 110–120° C. to initiate a low level of shrinkage in the copolymer and generate slight curl or spiral in the fibers for stabilization and cohesion purposes. The low heat will also activate the binder fibers, if present, adding strength to the batting. This can be particularly important for battings produced by methods other than needle punching, as mentioned above.

After any such initial heat setting, the batting is subjected to heat (at a higher temperature than any such initial heating) to generate maximum curl, spiral, or crimp in the fibers, without melting or otherwise degrading them. This heat-setting is to create a more permanent, highly crystalline state, and to minimize removal of such curl, spiral, or crimp when force is applied to stretch the batting. The preferred temperature for this step is 160–180° C., or 50–60° C. higher than the original heating cycle.

The addition of a soft latex resin, such as E-32, E-358, or TR-934 produced by Rohm & Haas or a similar performing resin product, is suggested for control of fiber migration or percolation through coverings. These may be added at levels of 12–18% of the gross batting weight and may be applied by spray using normal techniques for resin bonding settings during the second heating cycle for the batting. The use of resin may restrict stretch character but is used to add force to recovery and minimize elongation or permanent stretch.

I claim:

1. A process for preparing stretchable fibrous battings, comprising the steps of (1) forming a carded web of bicomponent fibers, the components of which exhibit differential shrinkage, (2) cross-lapping at an angle of about 30° to about 60° to build up a batt of the desired thickness and weight, (3) stabilizing the batt with the fibers in the batt thus cross-lapped, and (4) heat-setting the batt so as to effect differential shrinkage of the bicomponent fibers and thereby impart recoverable stretch to the batt.

2. A process for preparing stretchable fibrous battings, comprising the steps of (1) forming a blend of bicomponent fibers, the components of which exhibit differential shrinkage, with binder fibers that soften under conditions that do not soften the bicomponent fibers, (2) cross-lapping at an angle of about 30° to about 60° to build up a batt of the desired thickness and weight, (3) activating the binder fibers so as to provide a bonded batt, and (4) heat-setting the bonded batt so as to effect differential shrinkage of the bicomponent fibers and thereby impart recoverable stretch to the batt.

3. A process according to claim 2, wherein the binder fibers are sheath/core binder fibers with a sheath of binder material that softens to provide a bonded batt.

4. A process according to any one of claims 1 to 3, characterized in that the bicomponent fibers are polyester fibers, one component being poly(ethylene terephthalate) and the other component being poly[ethylene terephthalate/5-sodium-sulfo-isophthalate] containing about 2 mole % of the ethylene 5-sodium-sulfo-isophthalate repeat units.

5. A process according to any one of claims 1 to 4, characterized in that said bicomponent fibers that exhibit differential shrinkage have their components arranged side-by-side.

6. A multi-layered, cross-lapped, stretchable batt having recoverable extensions in the plane of the layers that are balanced to the extent such that the maximum recoverable extension is no more than about 1.5 times the recoverable extension in the direction at right angles to the direction of maximum recoverable extension, and comprising bicomponent fibers that have a helical curl on account of bicomponent differential shrinkage.

7. A stretchable batt according to claim 6, characterized in that it is through-bonded by reason of bonding by residues of binder fibers blended with the bicomponent fibers.

8. A batt according to claim 6 or 7, characterized in that the bicomponent fibers are polyester fibers, one component being poly(ethylene terephthalate) and the other component being poly[ethylene terephthalate/5-sodium-sulfo-isophthalate] containing about 2 mole % of the ethylene 5-sodium-sulfo-isophthalate repeat units.

9. A batt according to any one of claims 6 to 8, characterized in that said bicomponent fibers have their components arranged side-by side.

* * * * *